United States Patent [19]

King

[11] Patent Number: 4,942,704

[45] **Date of Patent: * Jul. 24, 1990**

[54] SPACER ELEMENT FOR MULTIGLAZED WINDOWS AND WINDOWS USING THE ELEMENT

[76] Inventor: Richard T. King, 101 NE. 62nd, Seattle, Wash. 98115

[ * ] Notice: The portion of the term of this patent subsequent to Jun. 6, 2006 has been disclaimed.

[21] Appl. No.: 359,507

[22] Filed: Jun. 1, 1989

Related U.S. Application Data

[63] Continuation-in-part of Ser. No. 233,535, Aug. 18, 1988.

[51] Int. Cl.[5] ..... E06B 7/12

[52] U.S. Cl. ..... 52/171; 52/172; 52/398; 52/573

[58] Field of Search ..... 52/573, 171, 172, 304, 52/398, 788, 789, 790; 428/34

[56] References Cited

U.S. PATENT DOCUMENTS

| | | | |
|---|---|---|---|
| 4,065,894 | 1/1978 | Day | 52/171 |
| 4,455,796 | 6/1984 | Schoofs | 52/171 |
| 4,542,611 | 9/1985 | Day | 52/172 |
| 4,604,840 | 8/1986 | Mondon | 52/172 |
| 4,607,468 | 8/1986 | Paquet | 52/172 |

FOREIGN PATENT DOCUMENTS 469433 11/1950 Canada .

*Primary Examiner*—David A. Scherbel
*Assistant Examiner*—Michele Van Patten
*Attorney, Agent, or Firm*—Keith D. Gehr

[57] ABSTRACT

The invention is a multiglazed window and a spacer element for the window. The spacer element is made in the form of an elongated body member of generally rectangular cross section. This has an elongated interior chamber located along its longitudinal axis. The chamber is partitioned by a flexible diaphragm into two separate chambers. One of these chambers is in communication through longitudinally spaced-apart apertures with the interior volume of the window. The other chamber is in communication through similar apertures with the outside environment. the diaphragm is preferably of S-shaped configuration having a cross sectional length which corresponds to half of the circumference of the interior chamber. As pressure changes occur between the gas within the window and the outside environment the diaphragm will reform to accommodate the resulting volume change. This maintains equal interior and exterior pressures preventing glass deformation. The spacer element may be a unitary extrusion or it may be a fabrication of separate body portions with a flexible diaphragm that could be of a different material.

33 Claims, 4 Drawing Sheets

FIG. 1
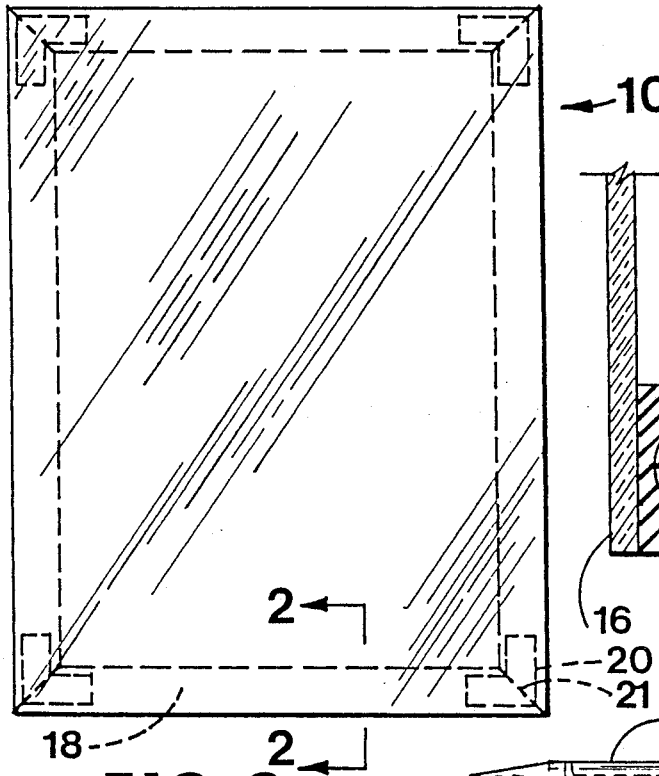
FIG. 4
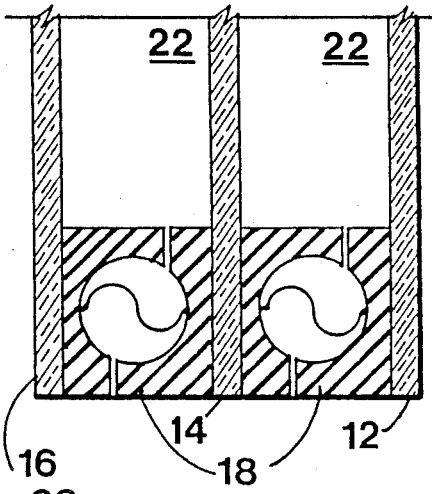
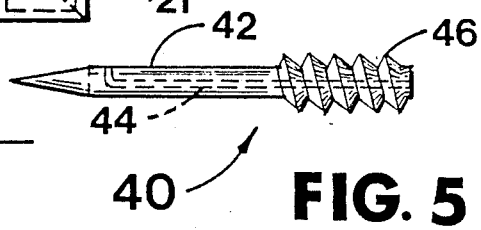
FIG. 5
FIG. 2
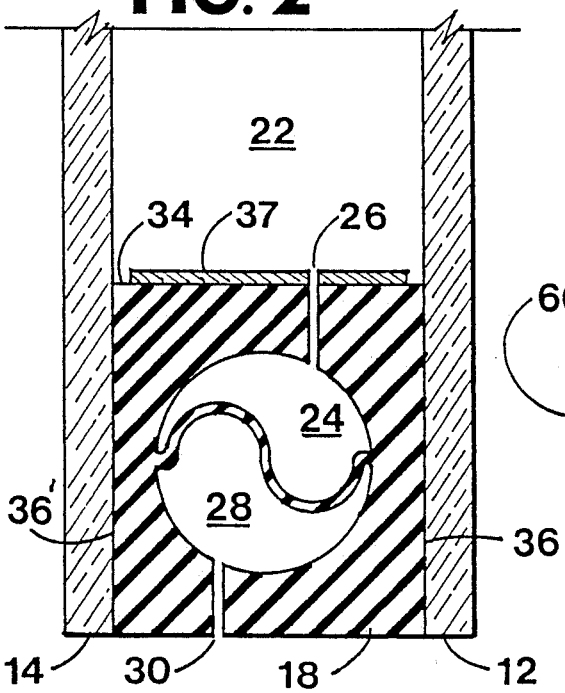
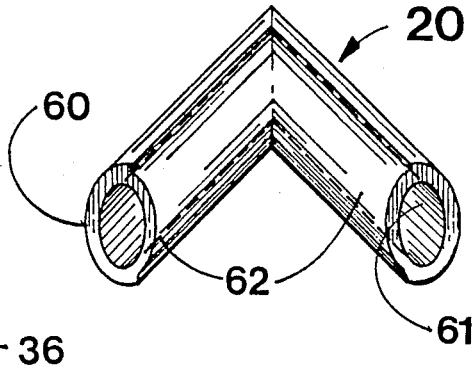
FIG. 9

FIG.8
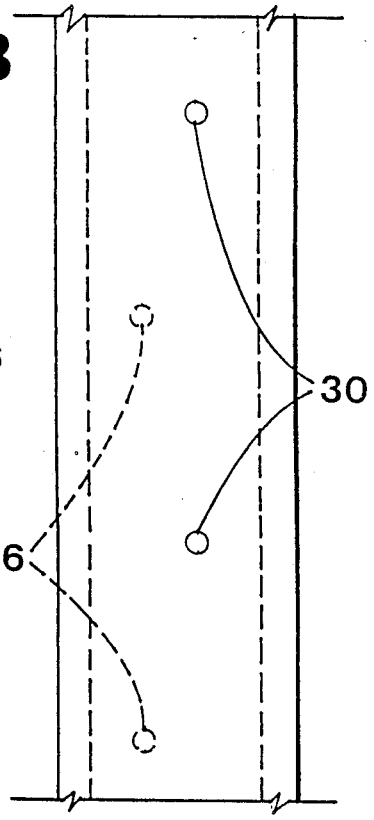
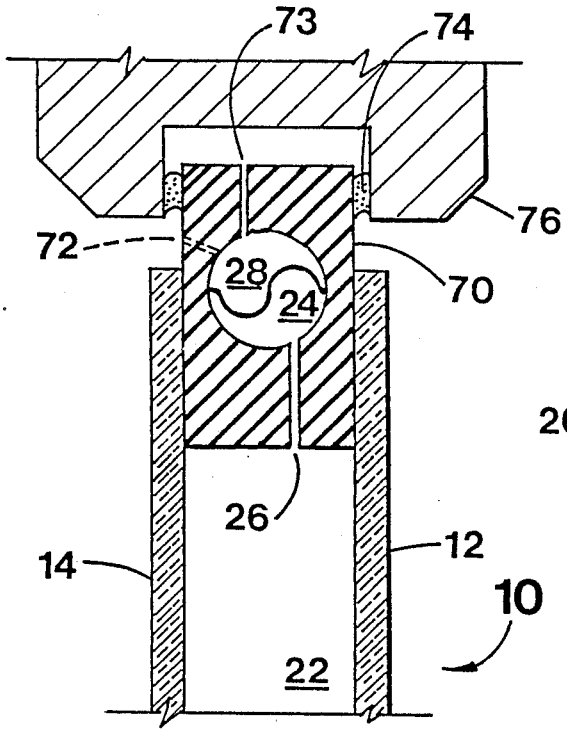
FIG. 7
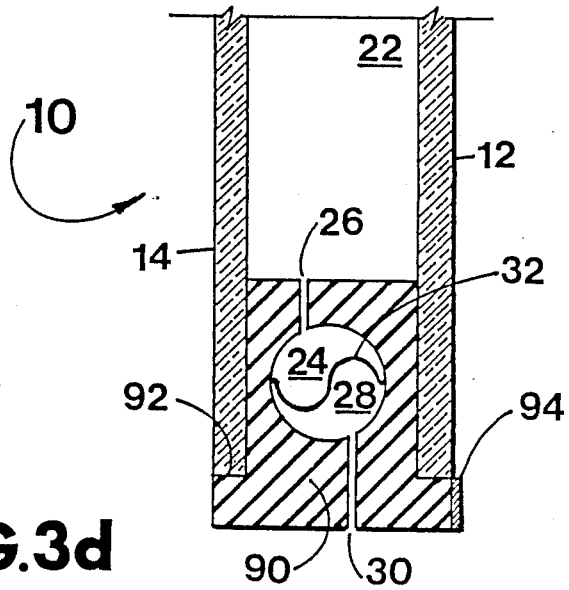
FIG.3d

SPACER ELEMENT FOR MULTIGLAZED WINDOWS AND WINDOWS USING THE ELEMENT

This application is a continuation-in-part of my earlier application, Ser. No. 233,535, filed Aug. 18, 1988.

BACKGROUND OF THE INVENTION

The present invention comprises a spacer element for use between the glass sheets or panels of multiglazed windows. It further comprises windows made using the spacer element.

Double or even triple glazed windows are now in almost mandatory use in new construction as an energy saving requirement. These windows normally employ two, and sometimes three sheets of glass. The individual glass sheets are separated by a molding or spacer along their edges. This molding normally is sized so that the individual sheets are in a range of about 10 to 16 millimeters apart. The interior volume of the window is sealed from the outside atmosphere to prevent entry of moisture and dust. Moisture entry, which will cause fogging on the interior surfaces, is a particularly serious problem. A number of complex systems, which often include use of a desiccant, have been developed to cope with the situation.

Another serious problem with multiglazed windows is deformation of the glass sheets due to a change in the internal gas pressure between the glass sheets as compared to the then ambient environmental atmospheric pressure. This positive or negative pressure differential can be caused by a number of factors: changes in barometric pressure, changes in temperature, or differences in normal conditions between the place of manufacture and the location of use. It is quite common that windows that are manufactured in a sea level environment are destined to be used in buildings at much higher elevations or at locations which experience severe cold during the winter. The first condition will cause a marked expansion of the gas within the interior volume of the window. The latter condition will cause a significant contraction of the interior gas volume. Expansion causes the glass sheets to deflect outwardly and become generally convex on their surfaces, rather than planar, while contraction of the interior gas causes the glass surfaces to deflect inwardly and become concave. In either case distortion is introduced when looking through the window and the building may take on a distinctly unfavorable outward appearance, especially where extensive glass curtain walls and glass spandrels are used as the exterior fenestration. These pressure changes within the windows also induce stress at the glue planes where the windows are bonded along their edges to the spacer that separates the individual glass sheets. This often causes leakage at this location during continued exterior and interior pressure equalization.

The prior art has recognized the above problems and attempted to deal with them, although not in a satisfactory manner until the present invention. As one example, Day, in U.S. Pat. No. 4,065,894, discloses a replaceable desiccant container that fits within a window frame. The desiccant is in communication with the interior volume of the window through a cannula. Preferably the container is both flexible and expandable. The inventor in this patent did not deal with the problems of where to locate the desiccant container or of providing access for replacing or servicing when the desiccant becomes saturated The above inventor, Day, in U.S. Pat. No. 4,542,611, shows another construction having a desiccant container along the spacer gasket of one edge of a double glazed window and an expandable bladder along another edge. One side of the bladder is vented to the atmosphere. This invention deals with both the problems of maintaining interior volume dryness and of accommodating expansion or contraction of the contained gas. In addition to being of relatively complex construction, the bladder is exposed both to view and to the deteriorating effects of ambient sunlight.

Schoofs, in U.S. Pat. No. 4,455,796, provides spacer bars filled with a desiccant between the panes. The spacer bars have access to the interior volume only at their ends and access to the external environment only at their center. The inventor states that incoming air; e.g., air flowing into the internal volume of the window due to a temperature drop, is demoisturized through long columns of desiccant in the spacer bar. Outgoing air, such as when the temperature increases, is said to be dry and to strip moisture from the desiccant to maintain its efficiency.

Mondon, U.S. Pat. No. 4,604,840, provides a spacer bar construction having an internal bellows. The bellows is vented to atmosphere on the outside and exposed to the interior space on the other side. The bellows can thus expand or contract as pressure in the internal volume changes. Mondon maintains the internal volume of the window isolated from the outside environment and there is no interchange of air as in the previously noted patent to Schoofs. Certain portions of the channels may also contain a desiccant material.

Paquet, in U.S. Pat. No. 4,607,468, shows an extruded spacer bar having a hollow core. The face of the spacer oriented towards the inside of the window is a thin expandable and contractible diaphragm of a different (softer) material than the rest of the construction. The other side of this diaphragm is vented to the atmosphere. In one version a desiccant is placed in a chamber on the interior side of the diaphragm.

All of the spacer bar construction described above are quite complex and would be expensive and difficult to fabricate, maintain, and install. For these reasons they have not found acceptance within the glass and glazing industry. The need therefore remains for a construction which is simple, inexpensive, of adequate life-cycle expectancy, and highly effective at maintaining multiglazed windows moisture free and distortion free under a wide range of environmental conditions. There is a further need for a system which will provide internal pressure or volume compensation to accommodate environmental differences between the point of manufacture and the location of use.

Rigid spacer bars of metal construction not mentioned hereinbefore but which are most commonly used today, must be of a bright and light finish in order not to absorb radiant heat within the internal window volume and thereby magnify the problems of volume expansion and contraction.

SUMMARY OF THE INVENTION

The present invention comprises an improved spacer strip or element for the glass panes or panels in double or triple glazed windows. The invention further includes windows made using the spacer element. The spacer element may be an extruded, flexible and resilient elongated member of any color desired. Alternatively, it may be made as a fabrication of several individual components, some or all of which may be metallic. It preferably has a generally rectangular cross section with first and second face portions and parallel spaced-apart side wall portions. In a window made using the spacer element, the first face portion faces the interior volume of the window and the second face portion is directed outwardly toward the frame support member and ambient atmosphere. Each of the side wall portions is preferably adhesively bonded to one of the glass sheets or panes which comprise the window. Alternatively, an external channel may be used as a clamp to hold the glass and spacer element in a tightly sealed non-shifting relationship.

The body member of the spacer element has an elongated interior chamber which is located along its longitudinal axis. This interior chamber is partitioned by a flexible diaphragm into two separate but adjoining chambers. These chambers are not in fluid communication with each other. While the separating diaphragm is flexible and moveable, it neither expands nor contracts; i.e., it does not change in crossectional length, to accomplish its purpose as do certain separating elements of the prior art.

A multiplicity of longitudinally spaced-apart first apertures pass between one of the chambers and the first face portion to provide fluid communication from the window interior to the first chamber. Similarly, a multiplicity of longitudinally spaced-apart second apertures, opening to the exterior environment, pass between the other separate chamber and the second face portion. All of these apertures are preferably normal to the longitudinal axis of the spacer element and to the face portions.

A longitudinal interior chamber may be circular to elliptical in cross section. The term "generally circular" should be considered to include either of these and similar configurations. The flexible diaphragm is of generally S-shaped configuration with the ends of the diaphragm anchored across a diameter of the interior chamber. In this way the diaphragm divides the interior chamber into two volumes of about equal cross sectional area. Most preferably, the diameter which serves as anchor points for the end of the separating diaphragm is one which is essentially normal to the side wall portions of the spacer element.

It is most desirable that the S-shaped flexible diaphragm should have a total length, as viewed in cross section, equal to about one half of the circumference of the interior chamber. When the spacer element is in place to separate the glass sheets of a multiglazed window, one of the chambers is in fluid communication with the interior volume between the glass sheets and the other chamber is in fluid communication with the external environment. The flexible diaphragm is then moveable to equalize pressure differences between the interior volume of the window and the external environment. At one extreme position, as when the internal volume within the interior of the window has been considerably reduced, the diaphragm will flex so that it lies along that portion of the periphery of the interior chamber closest to the inside of the window. In the opposite extreme condition, the diaphragm will flex and lie against the outer periphery of the interior chamber. The term "volume", as used above, should be understood to mean the sum of the internal volume between the glass sheets and the volume within that chamber in the spacer element in communication with this internal volume.

The interior chamber is sized so that it can accommodate the anticipated expansion or contraction of the gas within the internal volume of the window.

It is an object of the present invention to provide a simple, dependable, functional, practical and inexpensive spacer element for the glass sheets in multiglazed windows.

It is another object to provide a spacer element for multiglazed windows that can compensate for expansion or contraction of the gas within the internal volume of the window.

It is a further object to provide a multiglazed window which is essentially free of glass distortions which are caused by expansion or contraction of the gas within the internal volume due to temperature changes, barometric changes or other causes.

It is still another object to provide a spacer element that can be formed of a single extrusion.

It is an additional object to provide a spacer element that can be readily fabricated with different portions made from optimally selected materials.

It is yet a further object to provide a hermetically sealed window with a volume compensating means located entirely within the spacer element where it is not exposed or subjected to sunlight degradation and deterioration.

It is still a further object to provide a multiglazed window in which interior and exterior pressures are continually and automatically equalized.

These and many other objects will become readily apparent to those skilled in the art upon reading the following detailed description taken in conjunction with the drawings.

BRIEF DESCRIPTION OF THE DRAWINGS

FIG. 1 shows an elevation view of a multipane window.

FIG. 2 shows a section taken at lines 2—2 of FIG. 1.

FIG. 3*d* shows a fragmentary section through another embodiment of the invention.

FIG. 4 is a section through a triple pane embodiment of the invention.

FIG. 5 is a side elevation view of a pressure equalizing device.

FIG. 7 shows a fragmentary section through another embodiment of the invention.

FIG. 8 is a fragmentary elevation of a window edge exterior face.

FIG. 9 is a perspective view of a corner sealing fitting.

DESCRIPTION OF THE PREFERRED EMBODIMENTS

Figure 3A:
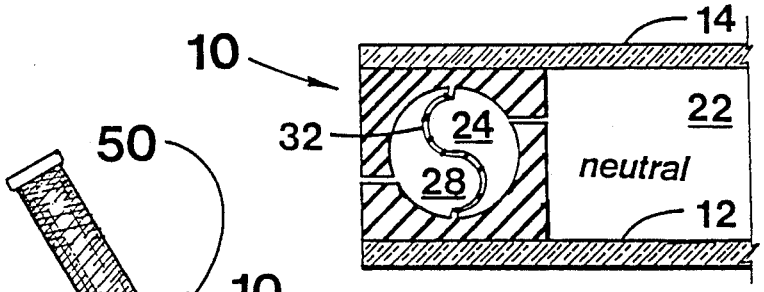
FIGS. 3*a* to 3*c* show sectional view of the diaphragm positions within the spacer molding for those conditions in which the internal volume is in neutral, expanded, or contracted condition.

The invention can be most readily understood by referring now to the drawings. FIGS. 1 through 4 show a multiglazed window 10. By "multiglazed" is meant a window having at least two panes of glass separated by a sealed internal volume of dead gas. Most typically the window will have two sheets of glass, but high insulation efficiency versions having three sheets of glass are now also common. FIG. 4 is an example of the latter construction while FIGS. 2 and 3 show the former construction.

The windows of the present invention have parallel planar glass panes 12, 14, 16 at some fixed distance apart typically in the range of 10–16 mm, which are separated by spacer elements 18. The spacer elements 18, as seen in FIG. 1, are joined at mitered corners 21 and permanently held in fixed relationship by solid corner fittings 20. As seen in FIGS. 2, 3 and 4 there is an internal volume 22 of dead gas between the sheets of glass. This volume will vary with changes in barometric pressure and temperature.

Spacer element 18 contains an elongated interior chamber which is divided into a window interior side chamber 24 and an atmosphere side chamber 28. The window interior side chamber 24 is in communication with the internal volume of the window through apertures or vents 26. In similar fashion the atmosphere side chamber 28 is in communication with the exterior environment through apertures or vents 30.

The internal diaphragm 32 that separates chambers 24 and 28 may be formed integrally with the main body member, as by extrusion of an impervious thermoplastic material.

Body element 18 has an inner or first face 34 which, in a finished window, is directed towards internal volume 22. An outer or second face 35 of the spacer molding is opposite the first and is directed towards the outside environment. While the first and second faces are conveniently planar in configuration this is not essential in any way. The term "generally rectangular" should be construed sufficiently broadly so as to accommodate significant deviations in planarity of the first and second faces.

The spacer element 18 also has planar and parallel side walls 36 and 36' that can have either smooth or textured surfaces. In the finished window these are bonded to glass sheets 12 and 14 using conventional bonding agents.

In one embodiment of the invention a rigid plastic or metallic element 37 is bonded to inner face 34 of the spacer element 18. This can conveniently serve as an anchor for structures such as internally located blinds or reflectors.

Figure 3B:
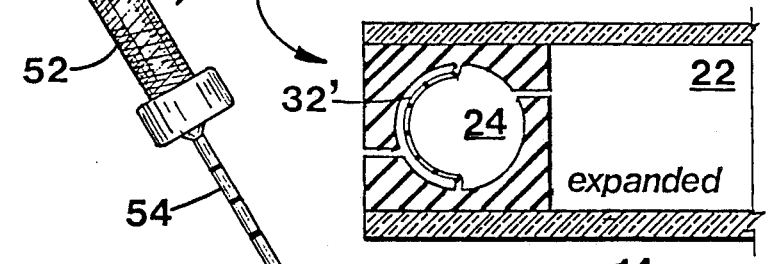
Figure 3C:
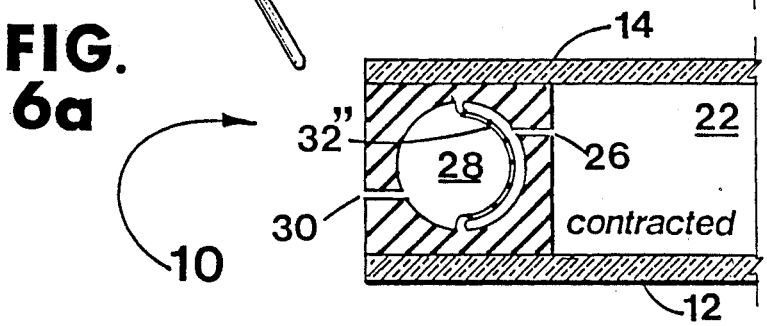

Operation of the device will now be explained and reference shall now be made to FIGS. 3*a*, 3*b*, and 3*c*. In FIG. 3*a* the internal diaphragm 32 is shown in its neutral position where it will preferably be when the window is installed under average environmental conditions of temperature and barometric pressure. Note that in all of these figures, and at all times, the internal pressure within the window and the ambient pressure are equal. In FIG. 3*b* the gas within the internal volume of the window has expanded; e.g., due to heating by sunshine. Note that diaphragm 32' has moved to a position against the outside periphery of chamber 28. The diaphragm position in FIG. 3*b* represents the maximum internal volume expansion which can be accommodated while maintaining internal pressure equal to exterior pressure. FIG. 3*c* shows the opposite situation; e.g., where the internal volume of gas has contracted significantly as it will in severe cold weather. Here diaphragm 32" has moved against the inner periphery of chamber 24. In the case where the interior volume expands, the internal gas flows through multiple orifices 26 into chamber 24 within the spacer element and air is exhausted through multiple orifices 30 from chamber 28. When the interior volume contracts, the opposite situation occurs. The volume sums of chambers 24 and 28 always equal unity and comprise the total volume of the interior longitudinal chamber.

As was noted earlier, the dimensions of separator element 18 and the size of interior chambers 24 and 28 can be determined by the maximum contraction or expansion expected under conditions of use. This can be readily calculated.

FIG. 8 shows the preferred placement of multiple orifices 26 and 30. These are formed at longitudinal intervals along the first and second faces. Orifices 26 will align with similar orifices in the strip 37 (FIG. 2), when this element is used.

It is very desirable that the gas volume within the window be adjusted to the average expected environmental situation prior to installation of the windows. Thus, if a window was manufactured in a sea level environment, such as Seattle, and installed in a high elevation environment such as Denver, it might be necessary to release some of the internal gas within the window to equalize the pressure with that pressure which is normal at the use location. When the opposite situation prevails, it might be necessary to add internal volume gas to a window that might have been manufactured at a high elevation location for use at a sea level environment. This can be conveniently done by a tool such as the one shown in FIG. 5. Here a volume equalizing needle 40 is seen to have a shank 42 with an internal bore 44. A threaded end 46 can be connected to a metered source of dry gas, such as nitrogen, to provide appropriate volume stabilization. Needle 40 would normally be inserted through any corner element 20 of the resilient body member, rather than through the diaphragm 32, so that the resulting puncture will be permanently sealed without disturbing the hermetic integrity of the window. When the window unit is neutralized, no further attention will ever be required after installation.

Figure 6A:
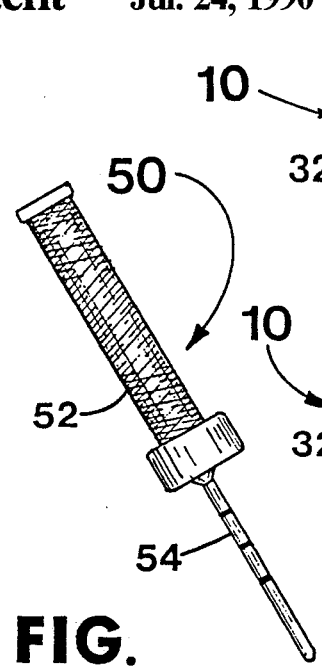
FIG. 6*a* is a side view of the diaphragm position-indicating gauge.
Figure 6:
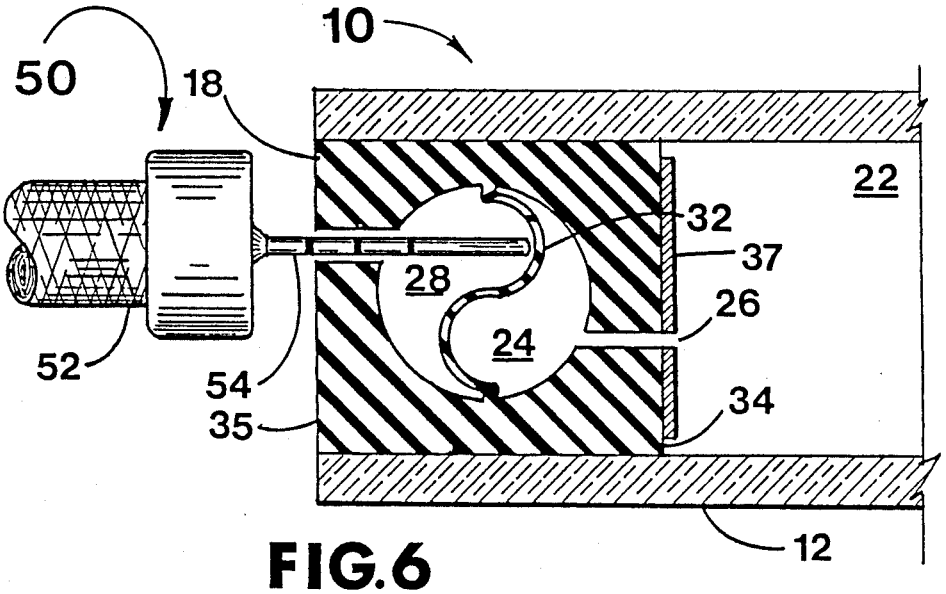
FIG. 6 is a sectional view of a diaphragm position-indicating gauge in operating position.

There is a relatively simple method of determining when the window is in a state of neutrality and diaphragm 32 is in a neutral position. A tool 50 of the general type shown in FIG. 6*a* can be quickly and simply used. This has a handle 52 and a calibrated rod 54 which is small enough in diameter to be insertable into any of the orifices 30. The method of use is indicated in FIG. 6. The calibrations on rod 54 can readily show when diaphragm 32 is in the neutral position.

While the corners of the spacer elements 18 can be simply mitered and cemented, as is shown in FIG. 1, it is preferred to create a more positive seal at the corner areas in order to prevent possible leakage. As is shown in FIG. 9, corner fittings 20, which may be made of the same material as spacer element 18, have an outer surface 60 configured to be a snug fit with the periphery of the atmosphere side of chamber 28 and a front surface 62 which would conform with diaphragm 32" in the contracted state as is shown in FIG. 3*c*. Thus, each rectangular window would have four essentially independent spacer elements 18 bonded together at all corners. Fittings 20 with any angle between acute and obtuse can be manufactured in order to accommodate required end sealing connections for windows of any shape. The corner fittings can be manufactured in either solid or tubular form. In the latter case a desiccant may be included within the interior portion 61 if desired. While this will not normally be necessary it does provide insurance against long term diffusion of very small amounts of moisture into the interior volume of the window.

The embodiment shown in FIG. 7 displays one of the many variations possible in the present invention. Here a spacer element 70 is used in such a manner that it protrudes from between glass sheets 12 and 14. This protruding portion can be mounted in a supporting structure 76, for example by the use of a caulking or sealing compound 74. The modified spacer element 70 has vents 72 to atmosphere located so as to be open when the window is sealed into its mounting. Apertures 73 are used to determine the neutral position of the diaphram before the window is installed.

A further variation is shown in FIG. 3*d*. This has some semblance to the embodiment of FIG. 7 in that spacer element 90 is designed to extend beyond the edges of glass sheets 12 and 14. In the present version, spacer element 90 has shoulders 92 which abut against the edges of the glass sheets. These may optionally have metallic or plastic strips 94 bonded to the shoulder portions, or the shoulder portions themselves may be made wider than the window thickness to provide edge protection.

Figure 10:
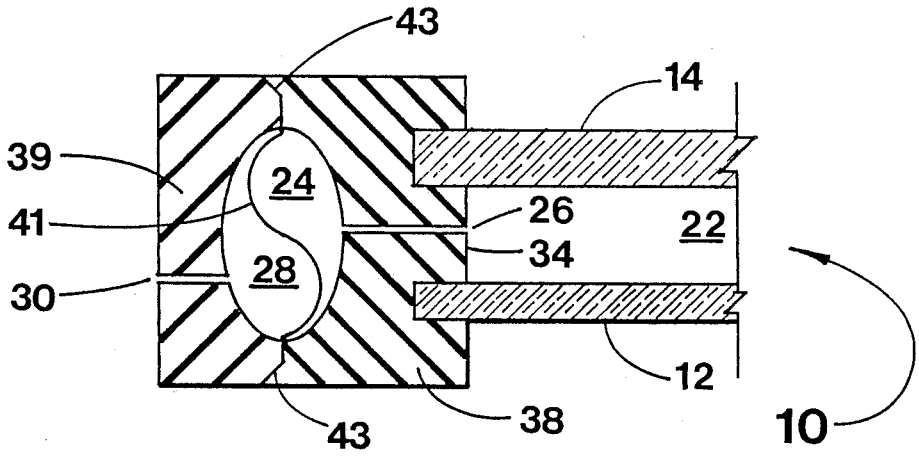
FIGS. 10 and 11 are sectional views showing alternative constructions of the spacer element and of windows using the element
Figure 11:
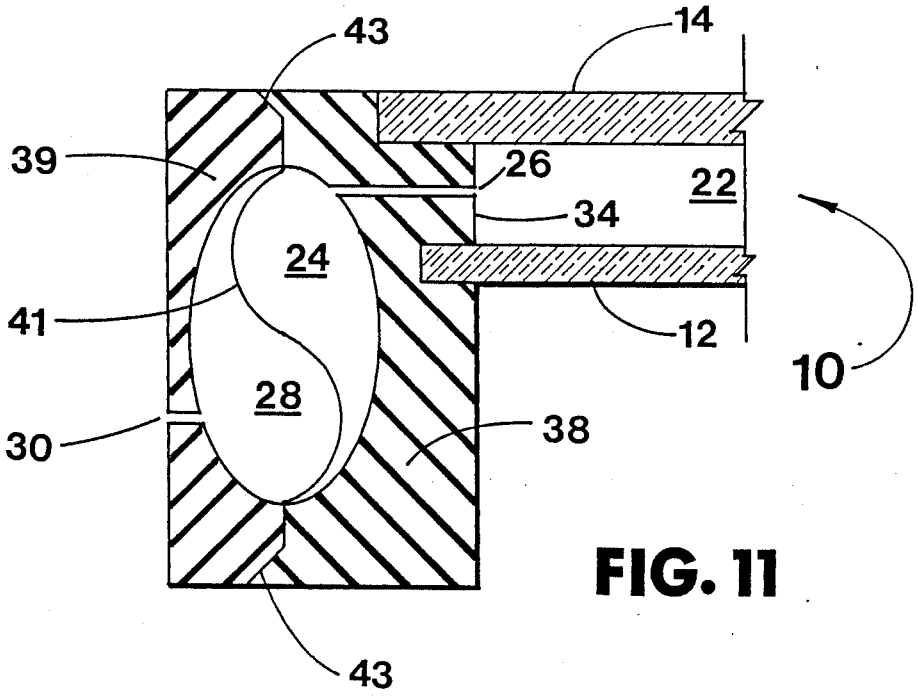

It is not necessary for the spacer element of the invention to be formed as a unitary construction. The body element may be of one material and the flexible diaphragm of another. As shown in FIGS. 10 and 11 the body element may be divided into two closely fitting parts 38, 39 with chambers 24, 28 being separated by flexible diaphragm 41. Diaphragm 41 is adhesively bonded to each of the body parts 38, 39 at glue lines 43. The two body portions may be either similar or dissimilar materials to accommodate the requirements for hermetic sealing and structural integrity. They may be made of flexible, resilient polymeric materials or one both may be metallic. The first face portion 34 may have one or more grooves formed in it to accept the edge of a glass sheet.

It is important for the diaphragm to be a highly flexible material with very low permeability to water vapor. A number of thermoplastic and metallic materials will fill this requirement. These would normally be in the form of thin films or foils typically having a thickness of the order of about 0.02 to 0.03 mm. This thickness could vary considerably depending on the particular material selected. One such material would be a polyester film which could be metallized to further reduce its water vapor permeability. A composite of thermoplastic and metallic foils would also be suitable.

The interior chamber comprising separate chambers 24, 28, which comprise the elongated volume compensating chamber described previously, may be made proportionately larger to accommodate the greater internal volume 22 of a larger window. In the case of a large window chambers 24, 28 may be located totally outside the panes of glass, as is shown in FIGS. 10 and 11, rather than between them as is shown in FIGS. 1 through 8. In general, it is desirable for the interior chamber to approximate in total volume the anticipated volume change within the window caused by the extremes of environmental conditions to which the window will be exposed.

The present invention has a number of advantages over the other systems taught in the prior art which are attempting to accomplish some of the same purposes. It is of low cost, versatile, and simple. Its high degree of effectiveness permits the manufacture of windows having a wide operational temperature range as wall as use of window glass of differing thicknesses on each side. This is possible since the glass remains essentially unstressed by internal pressure changes. For this reason internal pressure does not enter into glass thickness design calculations. The spacer element may also be used to create windows with shapes other than rectangular; e.g., round or oval. Further, the spacer element may be used with windows which are not flat and which have curved configurations such as a segment of a cylinder or sphere. In this case the term "parallel sheets of glass" shall be construed sufficiently broadly so as to include those curved configurations in which the glass sheets are overall equidistantly spaced from each other. Other important advantages may not be so readily apparent. Presently used spacer elements in multiglazed windows almost invariably have a bright, highly reflective surface to reduce heat buildup. This is not at all necessary for the spacer elements of the present invention. They may be of any color desired for the particular architectural environment in which the windows will be installed. Also, they may be of uniform appearance and construction around the entire perimeter, quite in contrast with many of the proposed volume compensating constructions shown in the prior art.

It will be understood by those skilled in the art that many variations can be made in the products described without departing from the spirit of the invention. For example, the spacer element could be used with many impervious materials other than transparent glass to create panels that have similar or dissimilar use requirements. Thus, the invention shall be considered as being limited only by the following claims.

I claim:

1. A spacer element for glass sheets in a multiglazed window which comprises:

an elongated body member of generally rectangular cross section, said body member having first and second face portions and parallel spaced-apart sidewall portions, the body member having an elongated interior chamber generally located along its longitudinal axis, said interior chamber being partitioned by a flexible diaphragm means into two separate chambers not in fluid communication with each other, said diaphragm being of generally sinuous configuration, the ends of the diaphragm being anchored across a diameter of the interior chamber so as to divide the interior chamber into two portions of essentially equal cross sectional area;

a multiplicity of longitudinally spaced-apart first apertures which pass between one of the separate chambers and the first face portion; and a multiplicity of longitudinally spaced-apart second apertures which pass between the other separate chamber and the second face portion, so that when the spacer element is in place to separate the glass sheets of a multiglazed window, one of the chamber is in fluid communication with the interior volume between the glass sheets and the other chamber is in fluid communication with the external environment, the diaphragm means being moveable to equalize pressure differences between the interior volume of the window and the external environment.

2. The spacer element of claim 1 in which said first and second apertures are generally normal to the longitudinal axis of the spacer element.

3. The spacer element of claim 1 in which the total length of the flexible diaphragm means, as seen in cross section, is equal to about one half of the circumference of the interior chamber.

4. The spacer element of claim 1 in which one face portion of the body member contains at least one groove to accept the edge of a glass sheet.

5. The spacer element of claim 1 in which the longitudinal interior chamber is of generally circular or elliptical cross section.

6. The spacer element of claim 5 in which the ends of the flexible diaphragm means are anchored across a diameter of the interior chamber which is essentially normal to the sidewall portions.

7. The spacer element of claim 5 in which the interior chamber is essentially elliptical in cross section and the ends of the flexible diaphragm means are anchored across the major diameter of said interior chamber.

8. The spacer element of claim 1 in which the body member is formed from two separate portions joined together at the diameter of the interior chamber comprising the anchor points of the flexible diaphram means.

9. The spacer element of claim 8 in which the body member portions are a flexible resilient material.

10. The spacer element of claim 8 in which the body portions are a metallic material.

11. The spacer element of claim 8 in which one face portion of the body member contains at least one groove to accept the edge of a glass sheet.

12. The spacer element of claim 8 in which the flexible diaphragm means within the interior chamber is a separate element held between the body member portions.

13. The spacer element of claim 12 in which the flexible diaphragm means is selected from thermoplastic film materials and metallic foils.

14. The spacer element of claim 13 in which the flexible diaphragm means is a polyester film.

15. A multiglazed window which comprises:

at least two parallel sheets of glass, adjacent sheets being separated along their edges by spacer elements to define an interior volume entirely isolated from the ambient atmosphere;

each spacer element further comprising an elongated body member of generally rectangular cross section, said body member having first and second face portions and parallel spaced-apart sidewall portions, the body member having an elongated interior chamber generally located along its longitudinal axis, said interior chamber being partitioned by a flexible diaphragm means into two separate chambers not in fluid communication with each other, said diaphragm being of generally sinuous configuration, the ends of the diaphragm being anchored across a diameter of the interior chamber so as to divide the interior chamber into two portions of essentially equal cross sectional area;

a multiplicity of longitudinally spaced-apart first apertures which pass between one of the separate chambers and the first face portion; and a multiplicity of longitudinally spaced-apart second apertures which pass between the other separate chamber and the second face portion, so that one of the chambers is in fluid communication with the interior volume between the glass sheets and the other chamber is in fluid communication with the external environment, the diaphragm means being moveable to equalize pressure differences between the interior volume of the window and the external environment.

16. The multiglazed window of claim 15 in which said first and second apertures in the spacer element are generally normal to the longitudinal axis of the spacer element.

17. The multiglazed window of claim 15 in which the total length of the flexible diaphragm means in the spacer element, as seen in cross section, is equal to about one half of the circumference of the interior chamber.

18. The multiglazed window of claim 15 in which the ends of the flexible diaphragm means of the spacer element are anchored across a diameter of the interior chamber which is essentially normal to the sidewall portions.

19. The multiglazed window of claim 15 in which the spacer elements are of uniform construction and appearance around the entire perimeter of the window.

20. The multiglazed window of claim 15 in which the interior chamber approximates in volume the anticipated volume change within the window due to extremes of environmental exposure.

21. The multiglazed window of claim 15 in which the body member portions of the spacer element are a flexible resilient material.

22. The multiglazed window of claim 15 in which the body member portions of the spacer element are a metallic material.

23. The multiglazed window of claim 15 which further comprises a plurality of spacer elements joined together with fittings inserted into the portion of the interior chamber in communication with the interior volume of the window, said fittings containing a desiccant accessible to the gas within said internal volume.

24. The multiglazed window of claim 15 in which the spacer element extends outwardly beyond the edges of the glass sheets.

25. The multiglazed window of claim 24 in which the interior chamber is located outwardly of the edges of the glass sheets.

26. The multiglazed window of claim 24 in which the extending portion of the spacer element has transversely extending shoulders which abut the edges of the glass sheets.

27. The multiglazed window of claim 24 in which the first face portion of the spacer element faces the interior volume of the window and said face portion contains at least one groove to accept the edge of at least one of the glass sheets.

28. The multiglazed window of claim 15 in which the body member of the spacer element is formed of two separate portions joined together at the diameter of the interior chamber comprising the anchor points of the flexible diaphragm means.

29. The multiglazed window of claim 28 in which the flexible diaphragm means within the interior chamber is a separate element held between the body element members.

30. The multiglazed window of claim 29 in which the flexible diaphragm means is selected from thermoplastic film materials and metallic foils.

31. The spacer element of claim 30 in which the flexible diaphragm means is a polyester film.

32. The multiglazed window of claim 15 in which the longitudinal interior chamber of the spacer element is of generally circular or elliptical cross section.

33. The multiglazed window of claim 32 in which the interior chamber is essentially elliptical in cross section and the ends of the flexible diaphragm means of the spacer element are anchored across the major diameter of the interior chamber.

* * * * *